US006951064B2

(12) United States Patent
Wüster

(10) Patent No.: US 6,951,064 B2
(45) Date of Patent: Oct. 4, 2005

(54) CLOTHES DRIER

(76) Inventor: Heinrich Wüster, Unterm Hohen Rain 16, A-6460 Imst/Tirol (AT)

( * ) Notice: Subject to any disclaimer, the term of this patent is extended or adjusted under 35 U.S.C. 154(b) by 0 days.

(21) Appl. No.: 11/064,339

(22) Filed: Feb. 23, 2005

(65) Prior Publication Data

US 2005/0150128 A1 Jul. 14, 2005

Related U.S. Application Data

(63) Continuation of application No. PCT/EP2003/009204, filed on Aug. 20, 2003.

(30) Foreign Application Priority Data

Aug. 23, 2002 (AT) ..... A 1263/2002

(51) Int. Cl.[7] ..... F26B 25/00
(52) U.S. Cl. ..... 34/239; 211/1.3
(58) Field of Search ..... 34/239, 201, 240, 34/103, 225; 211/1.3, 197, 175, 86.01

(56) References Cited

U.S. PATENT DOCUMENTS 3,647,073 A * 3/1972 Steiner ..... 211/1.3
3,920,127 A * 11/1975 LaBeaud ..... 211/118
4,376,525 A 3/1983 Frémy
4,739,888 A 4/1988 Steiner
4,921,110 A * 5/1990 Garcia ..... 211/1.3

FOREIGN PATENT DOCUMENTS

| | | | |
|---|---|---|---|
| AT | 003 328 | U1 | 1/2000 |
| CH | 682 679 | A5 | 10/1993 |
| EP | 0 479 729 | A1 | 4/1982 |
| EP | 0 260 332 | A1 | 3/1988 |
| EP | 0 806 517 | A2 | 11/1997 |
| EP | 0 987 361 | A1 | 3/2000 |
| GB | 1125812 | | 9/1968 |
| JP | 08112494 | A | 5/1996 |

* cited by examiner

*Primary Examiner*—Kenneth Rinehart
(74) *Attorney, Agent, or Firm*—Laurence A. Greenberg; Werner H. Stemer; Ralph E. Locher

(57) ABSTRACT

A clothes drier has lifting device that can be fastened to a ceiling and that can be operated in stepwise fashion. The lifting device supports a drier frame carrying the clothes line. The lifting device is received in a downwardly open profiled box, which can be fastened to the ceiling, and acts on the central longitudinal support of the drier frame, which can be folded together to form a long bar and in the folded-together state can be received in the profiled box. The frame has part-frames arranged on both sides of its longitudinal support, which can be folded together toward the longitudinal support and in the process in each case enclose the clothes line carried by them.

5 Claims, 2 Drawing Sheets

CLOTHES DRIER

CROSS-REFERENCE TO RELATED APPLICATION

This is a continuing application, under 35 U.S.C. § 120, of copending international application No. PCT/EP2003/009204, filed Aug. 20, 2003, which designated the United States; this application also claims the priority, under 35 U.S.C. § 119, of Austrian patent application No. A 1263/2002, filed Aug. 23, 2002; the prior applications are herewith incorporated by reference in their entirety.

BACKGROUND OF THE INVENTION

Field of the Invention

The invention relates to a clothes drier in which a lifting device that can be fastened to a ceiling and can be operated in stepwise fashion supports a drier frame carrying the clothes line.

A clothes drier with a lifting device that is fastened to the ceiling and can be operated in stepwise fashion is known from Austrian utility model AT 3 328 U1 (corresponding to U.S. Pat. No. 4,376,525). There, a rigid, rectangular frame, in which the clothes line runs parallel to its longitudinal sides, is suspended at its four corners on four cords. The four cords hang down from two winding spools, which are each assigned to a narrow side of the frame and are located on a shaft of the lifting device, which can be set in rotation via an endless cord pull. A separate supporting framework which can be folded together in scissors-like fashion can be incorporated into the rigid frame in order for it to be possible to use the latter, separated from the lifting device, for drying clothes in the open as well.

Clothes driers are known which have a drier frame which can be folded together on itself toward a central longitudinal support and consists of two rectangular part-frames which are arranged on the two sides of the central longitudinal support, carry the clothes line and can be folded together toward the central longitudinal support to form a narrow bar, the clothes line being enclosed in the folded-together part-frame. The drier frame which can be folded together to form a narrow bar is supported by a height-adjustable floor stand. The supporting device for the drier frame which can be folded together on itself to form a narrow bar can also be formed by four legs which are articulated at the ends of the central longitudinal support of the drier frame and can be folded out downward.

A clothes drier is also known in which the drier frame which carries the clothes line and consists of a central longitudinal support and two terminal transverse supports is suspended, via a rope pull and two articulated arms, on two ceiling brackets arranged above the longitudinal support ends and fastened to the ceiling at a distance from one another. The drier frame is raised and lowered via the two pull ropes of the rope pull, which act on the ends of the longitudinal support, are in each case deflected at the ceiling brackets and, in the region of the ceiling brackets, run through clamping devices which are fastened to the brackets and are pulled tight or released by pulling on the ropes. Each articulated arm is fastened pivotally to both one end of the longitudinal support and the ceiling bracket located above it. When the drier frame is being raised, both ropes must be pulled as evenly as possible so as to ensure an approximately horizontal position of the drier frame during raising. On reaching the ceiling brackets, care must be taken that both ropes are clamped so as to secure the drier frame to the ceiling and to prevent the drier frame falling down on one side or both sides.

SUMMARY OF THE INVENTION

It is accordingly an object of the invention to provide a clothes drier, which overcomes the disadvantages of the heretofore-known devices and methods of this general type. With the foregoing and other objects in view there is provided, in accordance with the invention, a clothes drier, comprising:

- a downwardly open profiled box to be fastened to a ceiling;
- a lifting device mounted in said profiled box and configured for stepwise operation;
- a drier frame having a central longitudinal support connected to and supported by said lifting device, having part-frames disposed bilaterally (on both sides) of said longitudinal support and carrying a clothes line;
- said drier frame being collapsible to substantially form an elongated bar in a folded-together state, in which said drier frame is received in said profiled box, and said part-frames being foldable towards said longitudinal support to thereby encase the clothes line.

In other words, there is provided a clothes drier in which a lifting device which can be fastened to a ceiling and can be operated in stepwise fashion supports a drier frame carrying the clothes line. The lifting device is received in a downwardly open profiled box, which can be fastened to the ceiling. It acts on the central longitudinal support of the drier frame, which can be folded together on itself to form a long bar and in the folded-together state can be received in the profiled box. The drier frame has part-frames arranged on both sides of the longitudinal support, which can be folded together toward the longitudinal support and in the process enclose the clothes line.

When the clothes drier is not in use, its drier frame is folded together to form a long bar and received in the downwardly open profiled box fastened to the ceiling. Before the washing is hung out, the drier frame folded together in a bar shape is, with the aid of the lifting device, lowered out of the profiled box to the desired height for use and then opened up to form a rectangular drier frame by unfolding its part-frames. The washing to be dried is then hung out on the clothes line of the drier frame, and the drier frame loaded with wet washing is raised to the desired drying height with the aid of the lifting device. In this connection, the unfolded drier frame loaded with wet washing can be raised to the downwardly open profiled box and pulled tight on it. To remove the dried washing, the unfolded drier frame loaded with washing is lowered to the desired height for use with the aid of the lifting device. After the washing has been removed, the drier frame is folded together to form a long bar again and, in the folded-together state, is raised to the ceiling and drawn into the downwardly open profiled box with the aid of the lifting device.

Another advantage of the clothes drier according to the invention is found in the downwardly open profiled box, which allows simplified mounting on the ceiling via lateral flanges.

The lifting device can comprise a rotatable winding shaft which runs in the longitudinal direction of the profiled box and is coupled to a locking mechanism for its rotary movement and to a rotary drive which, when actively operated, disengages or overcomes the locking mechanism, and can be operated via an endless cord pull for winding up or unwinding lifting ropes fastened to the longitudinal support of the drier frame.

This design makes it possible to lower or raise the drier frame in stepwise fashion without the person operating the clothes drier having to hold or raise the entire weight of the drier frame together with the heavy wet washing hung out.

The winding shaft can have an operating end projecting laterally beyond the profiled box and carrying the endless cord pull.

Another feature of the invention consists in that two articulated arms, which can be folded out of the profiled box and folded back into it again, connect the profiled box to the longitudinal support of the drier frame, each form a knee joint and face one another with their knee joints, are articulated in the interior of the profiled box and on the longitudinal support, and in that the two articulated arms can, when the drier frame is being raised, be folded back into the profiled box while their knee joints move closer to one another.

This design provides, in addition to the lifting device, a holding and guiding mechanism for the drier frame, the two articulated arms stabilizing the position of the unfolded drier frame in any vertical position. In the event of inadvertent knocking against the unfolded drier frame hanging down from the ceiling, the articulated arms prevent large swinging movements of the drier frame. When the drier frame, in the unfolded state, is raised to the profiled box, the lower ends of the two articulated arms, which ends are connected to the central longitudinal support of the frame, are drawn into the downwardly open profiled box. The folded-together articulated arms drawn into the profiled box bring about positional stabilization of the unfolded drier frame raised to the profiled box. To increase the positional stabilization, guiding-in slopes assigned in each case to the lower ends of the articulated arms can be provided on the inner side of the two longitudinal side walls of the profiled box, which are in each case arranged just next to the articulated arms on both sides of these.

The drier frame folded together to form a long bar and drawn into the profiled box can be designed as a lower covering of the profiled box.

Other features which are considered as characteristic for the invention are set forth in the appended claims.

Although the invention is illustrated and described herein as embodied in a clothes drier, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 2:
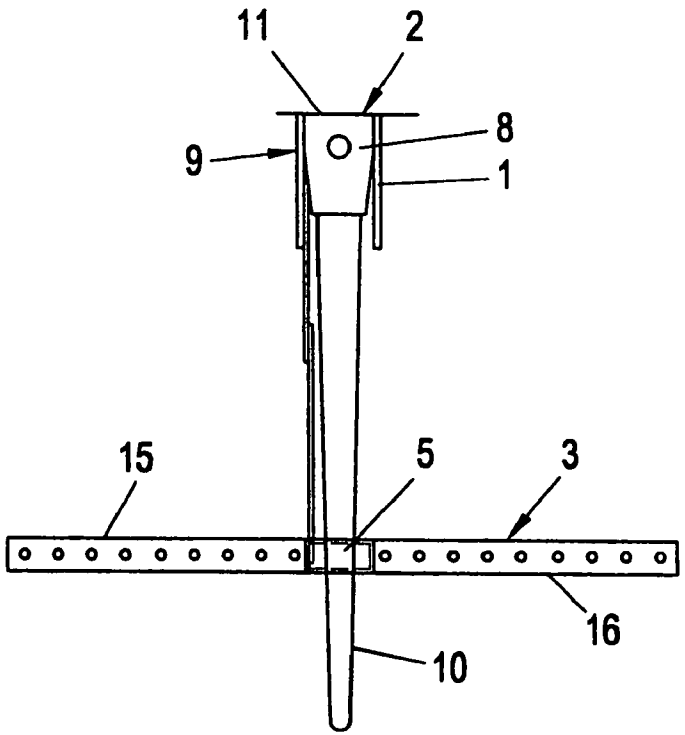
FIG. 2 is a side view of the operating side of the lifting device with the endless cord pull.
Figure 1:
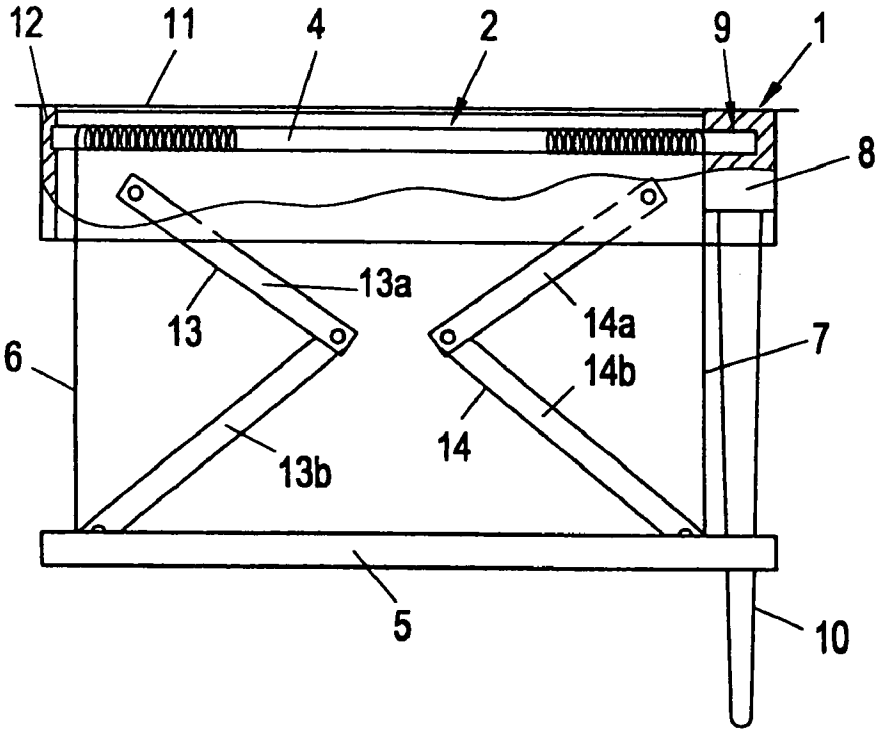
FIG. 1 is a diagrammatic elevation illustrating am embodiment of the clothes drier according to the invention, with a profiled box mounted on the ceiling and an unfolded drier frame drawn out downwardly from the box.
Figure 3:
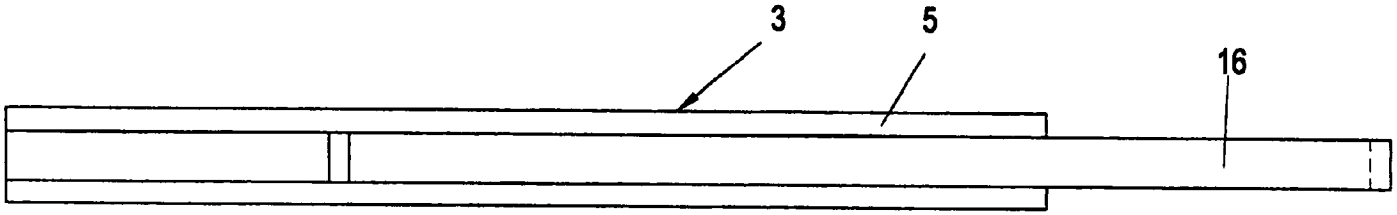
FIG. 3 is a diagrammatic view of the clothes drier according to the invention in a folded-together position.
Figure 4:
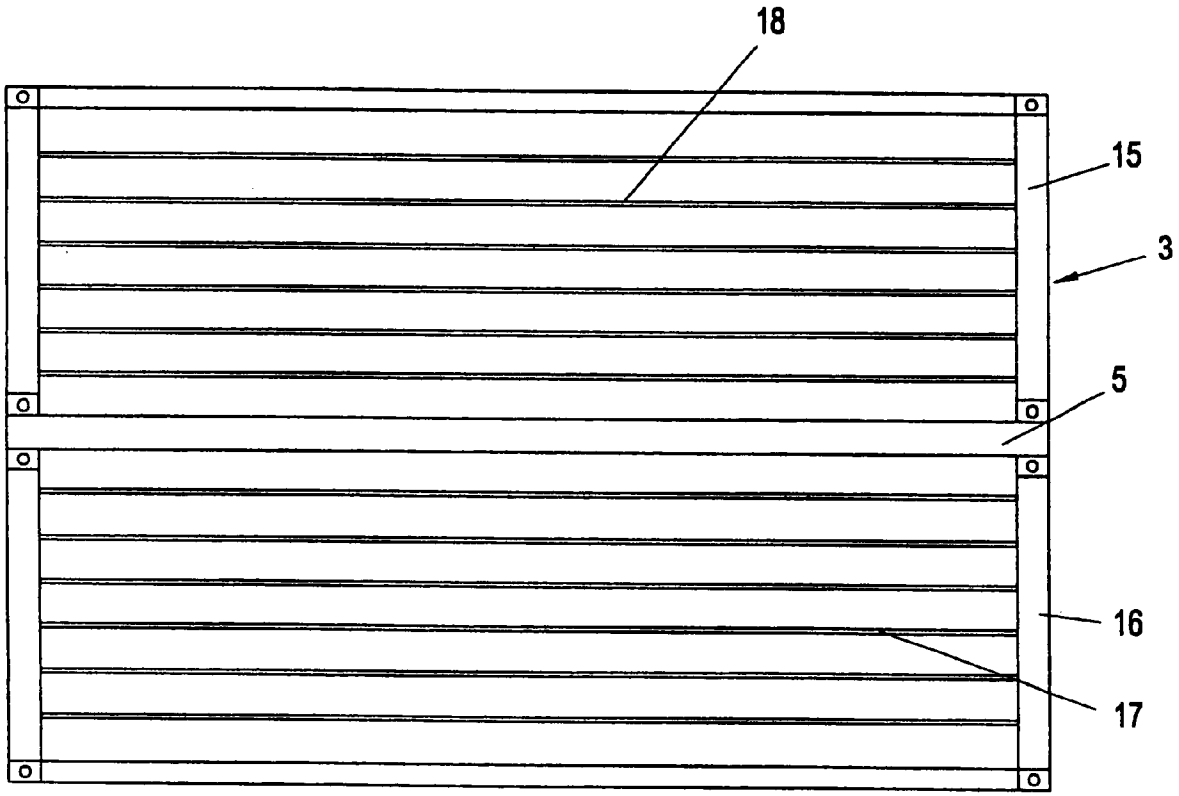
FIG. 4 is a view of the clothes drier in the unfolded position.

Referring now to the figures of the drawing in detail and first, particularly, to FIG. 1 thereof, there is shown an elongate, downwardly open profiled box 1, which contains a lifting device 2 for the unfoldable drier frame 3. The box 1 is mounted on the ceiling or on the underside of a balcony, for example. The lifting device 2 comprises a horizontal spindle or winding shaft 4, which is rotatably mounted in the profiled box 1 and on which two ropes 6, 7 disposed at a distance from one another and connected to the central longitudinal support 5 of the drier frame 3 are wound up or unwound. The ropes support the drier frame 3. The winding shaft 4 is coupled to a locking mechanism 8 for its rotary movement and to a rotary drive 9 which, when it is actively operated, disengages or overcomes the locking mechanism 8, and is operated via an endless cord pull 10 for rotating the winding shaft 4 when the lifting ropes 6, 7 fastened to the longitudinal support 5 of the drier frame 3 are wound up or unwound.

Two fastening flanges 12, to which the profiled box 1 is rigidly connected when it is being mounted, are fastened to the ceiling 11. Two articulated arms 13, 14, which each form a knee joint, are articulated on the profiled box 1, in its interior. These arms are articulated on the profiled box 1 with their upper arm parts 13*a*, 14*a* and on the longitudinal support 5 with their lower arm parts 13*b*, 14*b*. The knee joints of the two articulated arms 13, 14 face one another.

The drier frame 3 has two part-frames 15, 16, which are arranged laterally on its longitudinal support 5 and can be folded together toward the latter and opened away from it and which, when being unfolded, spread the respective clothes line 17, 18 parallel to the central longitudinal support 3 and, when being folded together, enclose the line in their frame profile parts.

To lower the drier frame 3 from the ceiling 11, the rotary drive 9 of the winding shaft 4 of the lifting device 2 is operated in the lowering direction via the endless cord pull 10 and in the process the rotation lock of the locking mechanism 8 is overridden. When the drier frame 3 has been lowered sufficiently, the endless cord pull 10 is released and, in the automatic locking mechanism 8, the rotation lock of the winding shaft 4 engages automatically.

To raise the drier frame 3 to the ceiling 11, the rotary drive 9 of the winding shaft 4 is operated in the lifting direction via the endless cord pull 10. At the same time, the rotation lock of the locking mechanism 8 is overridden until the endless cord pull 10 is once more released. The rotation lock of the winding shaft 4 in the automatic locking mechanism 8 then engages again, and the drier frame 3 is held in the respective position by the lifting device 2 via the engaged locking mechanism 8.

The rotary drive 9 of the winding shaft 4 can be designed as a self-locking gear unit, which can be actuated via the endless cord pull 10 and is coupled to the winding shaft 4.

I claim:

1. A clothes drier, comprising:

a downwardly open profiled box to be fastened to a ceiling;

a lifting device mounted in said profiled box and configured for stepwise operation;

a drier frame having a central longitudinal support connected to and supported by said lifting device, having part-frames disposed bilaterally of said longitudinal support and carrying a clothes line;

said drier frame being collapsible to substantially form an elongated bar in a folded-together state, in which said drier frame is received in said profiled box, and said part-frames being foldable towards said longitudinal support to thereby encase the clothes line.

2. The clothes drier according to claim 1, wherein said lifting device comprises:

a rotatable winding shaft extending in a longitudinal direction of said profiled box;

a locking mechanism for a rotary movement coupled to said winding shaft;

a rotary drive coupled to said winding shaft, said rotary drive, upon active operation, disengaging or overcoming said locking mechanism; and an endless cord pull for selectively winding and unwinding lifting ropes fastened to said longitudinal support of said drier frame.

3. The clothes drier according to claim 2, wherein said winding shaft has an operating end projecting laterally beyond said profiled box and carrying said endless cord pull.

4. The clothes drier according to claim 1, which comprises two articulated arms, configured to be folded out of and folded back into said profiled box, said articulated arms connecting said profiled box to said longitudinal support of said drier frame, each forming a knee joint and facing one another with the respective said knee joints, wherein said articulated arms are articulated in an interior of said profiled box and on said longitudinal support, and said articulated arms, when said drier frame is raised, folding back into said profiled box while said knee joints approach one another.

5. The clothes drier according to claim 1, wherein, in the folded-together state, with said drier frame forming an elongate bar and being drawn into said profiled box, said drier frame forms a lower covering of said profiled box.

* * * * *